United States Patent [19]

Membrino

[11] Patent Number: 4,527,693

[45] Date of Patent: Jul. 9, 1985

[54] BOX DISPENSER FOR PAD OF PLASTIC BAGS

[76] Inventor: Hercules Membrino, 280 Paoli Pike, Malvern, Pa. 19355

[21] Appl. No.: 602,693

[22] Filed: Apr. 23, 1984

Related U.S. Application Data

[63] Continuation-in-part of Ser. No. 588,567, Mar. 12, 1984, Pat. No. 4,500,000.

[51] Int. Cl.[3] ..... B65D 85/62

[52] U.S. Cl. ..... 206/554; 206/526; 206/494; 206/806

[58] Field of Search ..... 206/526, 554, 494, 449, 206/806

[56] References Cited

U.S. PATENT DOCUMENTS

| | | | |
|---|---|---|---|
| 1,522,220 | 1/1925 | Wood | 206/494 |
| 3,144,960 | 8/1964 | Membrino | 206/449 |
| 3,190,490 | 6/1965 | Membrino | 206/806 |
| 3,685,643 | 8/1972 | Garshelis | 206/494 |
| 3,899,079 | 8/1975 | Seiter | 206/634 |
| 4,046,257 | 9/1977 | Lehmacher | 206/554 |
| 4,201,299 | 5/1980 | Bumgarner et al. | 206/554 |
| 4,406,371 | 9/1983 | Membrino | 206/554 |

FOREIGN PATENT DOCUMENTS

| | | | |
|---|---|---|---|
| 850483 | 9/1970 | Canada | 206/554 |
| 1464148 | 11/1966 | France | 206/554 |
| 317029 | 11/1969 | Sweden | 206/494 |
| 411279 | 11/1966 | Switzerland | 206/526 |
| 1131063 | 10/1968 | United Kingdom | 383/8 |
| 2079249 | 1/1982 | United Kingdom | 206/554 |

*Primary Examiner*—William T. Dixson, Jr.
*Assistant Examiner*—Brenda J. Ehrhardt
*Attorney, Agent, or Firm*—Arthur A. Jacobs

[57] ABSTRACT

A plastic bag unit comprising a box having a removable flap covering an aperture in the front wall of the box, and a pad of bags positioned within the box, the pad comprising an upper base portion from which depends a stack of bag-forming pockets having open mouths, the pockets being connected to the base portion by score lines, and the open mouths facing the aperture; the base portion having connections at each side acting as anchoring counterforces against forward pull of individual pockets through the aperture, and the wall portion framing the aperture acting to exert additional counterforce against the forward pull, whereby the resulting pockets are simultaneously removed from the base portion, extracted from the box and fully opened by a simple forward pull.

9 Claims, 10 Drawing Figures

FIG. 1
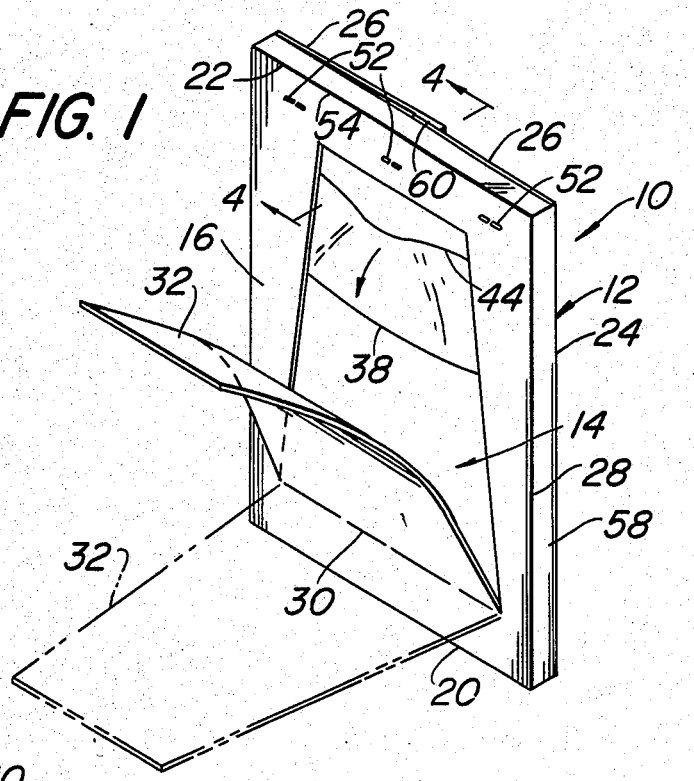
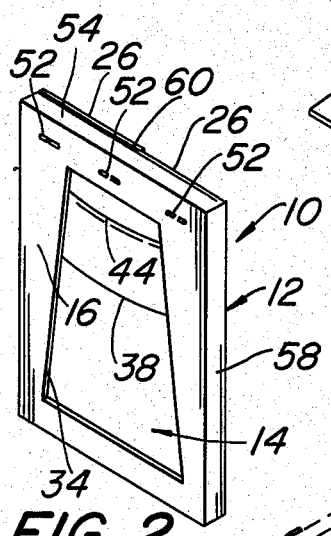
FIG. 2
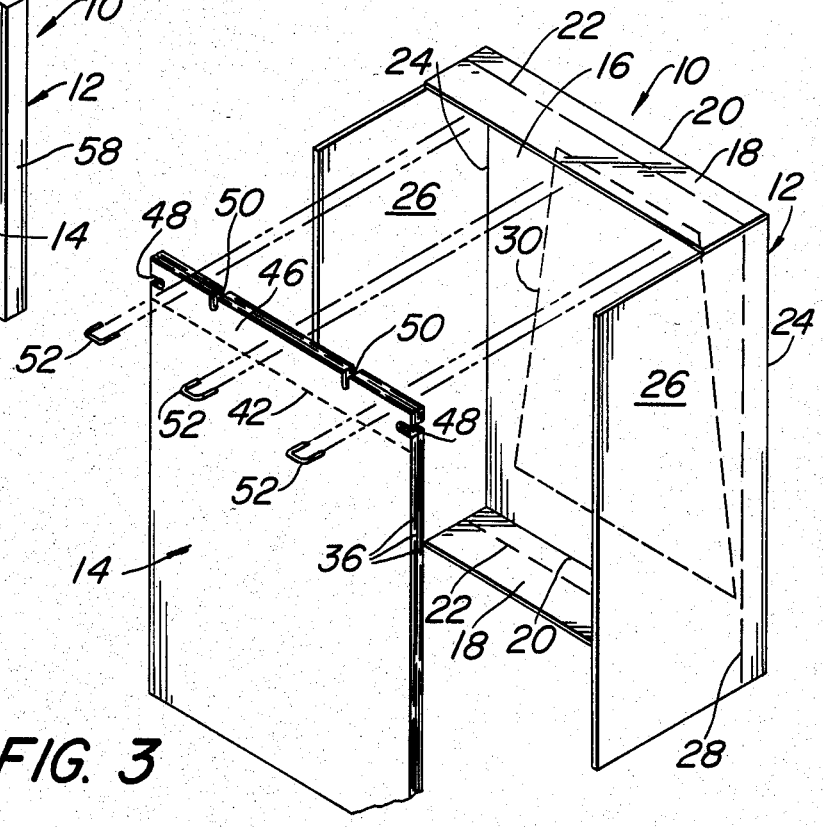
FIG. 3

FIG. 5
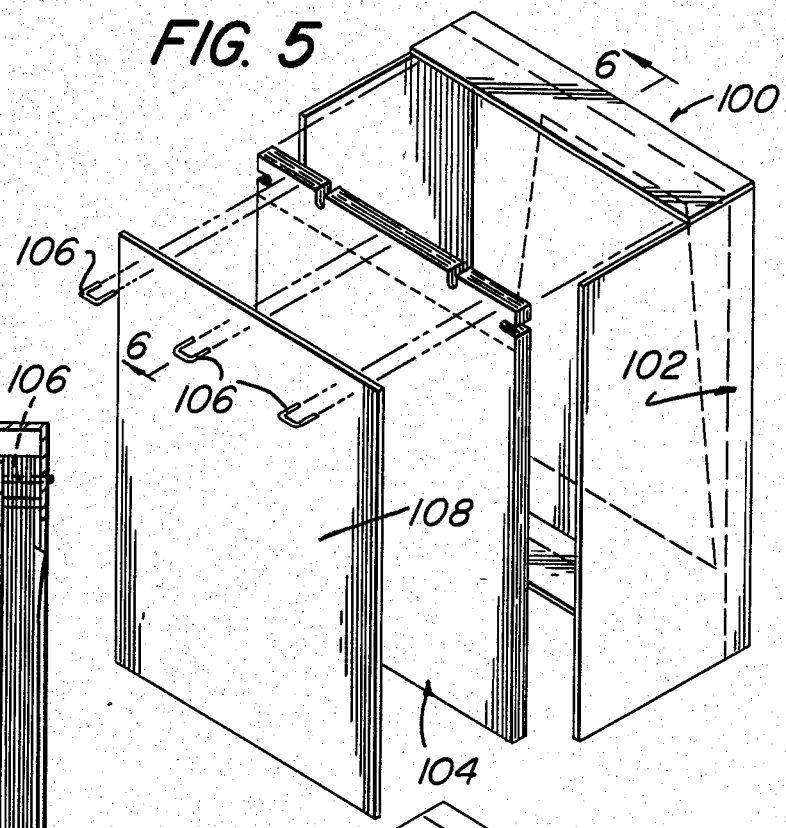
FIG. 4
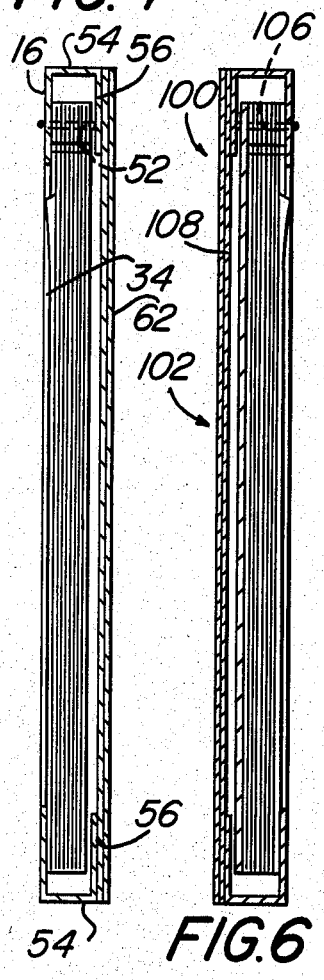
FIG. 6
FIG. 7
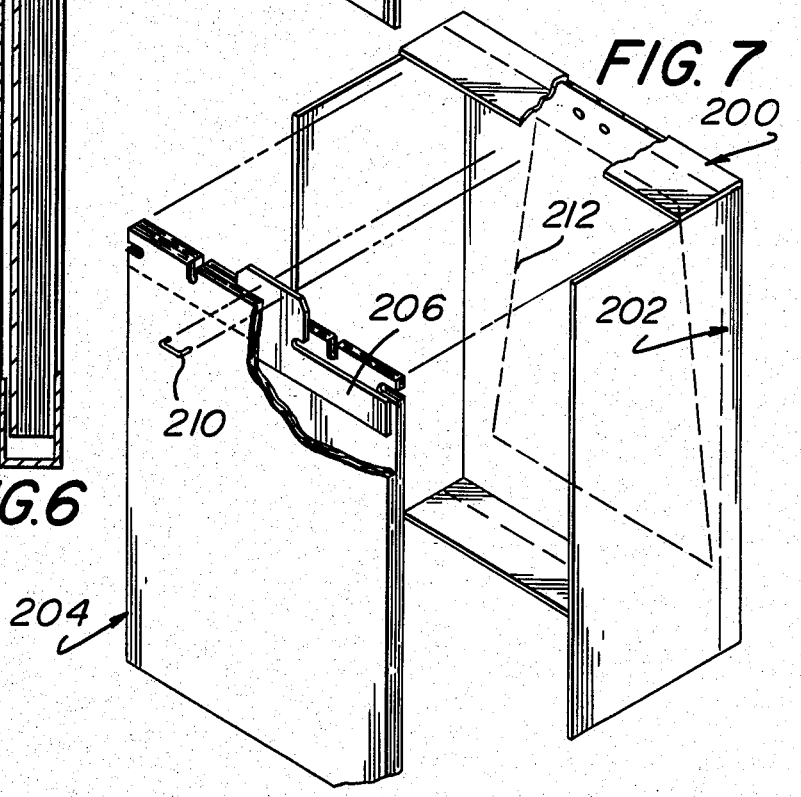

BOX DISPENSER FOR PAD OF PLASTIC BAGS

This application is a continuation-in-part of co-pending application Ser. No. 588,567, filed Mar. 12, 1984, now U.S. Pat. No. 4,500,000.

This invention relates to a plastic bag assembly comprising a pad of plastic bags and a storage and dispensing means for said pad, and it particularly relates to an assembly of this type which permits the bags to be dispensed individually from the storage and dispensing means.

The pad of bags disclosed in the aforesaid application Ser. No. 588,567 was intended to be utilized in an exposed hanging position. This required an exposed surface area in the kitchen or other room in which the pad was placed. As a result, not only were the bags exposed to cooking odors, dust and whatever other atmospheric conditions were present in the room, but the pad also took up wall and cabinet space that could not then be used for any other purpose. Since many modern kitchens have so many appurtinences that every possible area of space is utilized, a separate surface area for the pad of bags was often not available.

Box-type storage and dispenser means for plastic bags have heretofore been used. However, those prior devices comprise a roll or stack of bags within the box and an opening in the box through which one inserts the fingers, grasps the uppermost bag, and pulls it out. The bags obtained in this manner are in collapsed condition and difficult to open—that is, the walls as in all such plastic bags, tend to adhere to each other and it is, therefore, generally necessary to pull them apart before use. Furthermore, such an assembly is satisfactory only for very small bags because of the difficulty of opening collapsed large bags where there is a greater area of adherence between the walls. In addition, if the bags are in a roll, the roll occupies an inordinately large amount of space and it is sometimes difficult to remove the bags from the roll without tearing the bags themselves, while if they are in a stack, it is difficult to maintain them in stacked condition while inserting them into the box without the expenditure of much time and labor or the use of complicated and expensive machinery.

It is, therefore, an object of the present invention to provide a plastic bag storage and dispensing unit which is capable of not only dispensing the bags in an easy manner but also provides for self-opening of the bags as they are dispensed.

Another object of the present invention is to provide a plastic bag storage and dispensing unit of the above type which is capable of handling bags of both small and large size.

Another object of the present invention is to provide a plastic bag storage and dispensing unit of the above type which occupies a minimum amount of storage space and which is easily filled and easily handled.

Other objects and many of the attendant advantages of this invention will be readily appreciated as the same becomes better understood by reference to the following description when read in conjunction with the accompanying drawings wherein:

FIG. 1 is a front perspective view of a plastic bag storage and dispensing unit embodying the present invention.

FIG. 2 is a front perspective view, somewhat reduced, of the unit of FIG. 1 but with the front opening flap removed.

FIG. 3 is an exploded front perspective view showing the method of assembly for the unit of FIG. 1.

FIG. 4 is a sectional view taken on line 4—4 of FIG. 1.

FIG. 5 is an exploded front perspective view showing a modified form of the invention.

FIG. 6 is a sectional view, similar to FIG. 4, but showing the unit of FIG. 5.

FIG. 7 is an exploded front perspective view, similar to FIG. 5, but showing a further modification of the invention.

Figure 8:
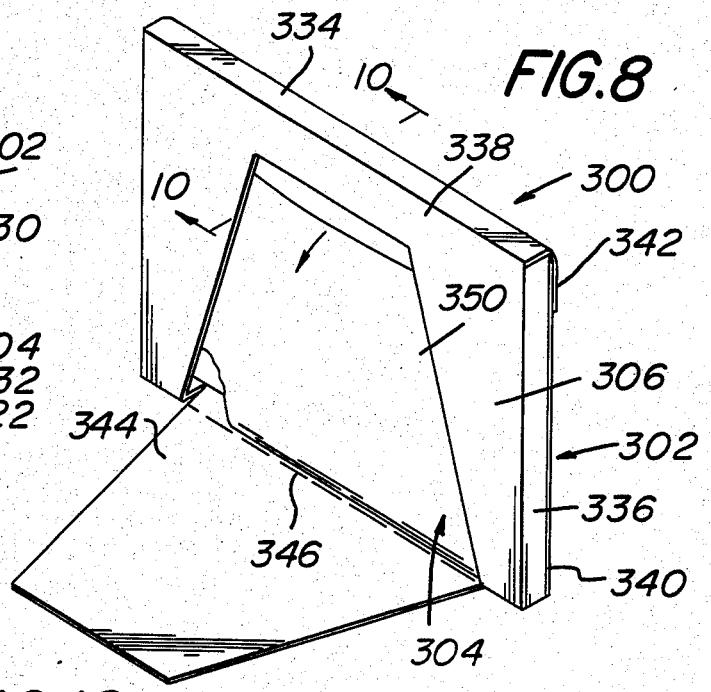
FIG. 8 is a front perspective view of a further modification of the present invention.

Referring in greater detail to the figures of the drawings wherein similar reference characters refer to similar parts, there is shown in FIG. 1 a plastic bag storage and dispensing unit, generally designated 10, which comprises a box 12 made of paper, cardboard, or any other desired material, and a pad of plastic bags 14 positioned within the box.

As best seen in FIG. 3, the box blank comprises a front wall 16 having top and bottom flaps 18 hingedly connected thereto by a fold line 20. Each flap 18 is provided with a longitudinal fold line 22. Also hingedly connected to the front wall 16 by fold lines 24 are a pair of side flaps 26, each of which has a longitudinal fold line 28.

The front wall 16 is provided with a score line pattern 30 framing a removable flap 32. The score line may be torn to either remove the flap 32 entirely, as shown in FIG. 2, or to hinge the flap 32 on the bottom of the score line pattern 30, as shown in FIG. 1. In either instance, an opening 34 is provided.

The pad of bags 14 is similar to that shown in the aforesaid application Ser. No. 588,567 in that it comprises a stack of bag pockets 36, each of which has an open mouth defined at its front by a free edge 38 forming the upper edge of the front wall of the pocket—which becomes an individual bag when separated from the pad. The rear wall of each pocket extends beyond the free edge 38 and has an upper edge 40. A score line 42 extends from edge to edge of the rear wall and defines the upper edge 44 of the rear wall of the bag which is formed by the pocket after it is torn away from the pad along the score line. The area between the score line 42 and the upper edge 40 constitutes a selvage portion 46. All of these selvage portions are welded together at their opposite ends, as shown at 48, and are also optionally provided with connecting welds 50 at their upper edges. These welded together selvage portions combine to form a base portion for the pad.

Although it is possible to substitute other connecting means for the welds, the welds are preferred.

In assembling the unit 10, the pad 14 is placed against the inside surface of the front wall 16 of the box blank and the base portion of the pad 14 is connected to the wall 16 by staples 52 or any other feasible connecting means. The box is then formed around the pad by folding on fold lines 20 and 22 to form the upper and lower walls 54 of the box, these walls being the areas between the folds 20 and 22. The areas extending away from the fold lines 22 form internal upper and lower flaps 56, as best seen in FIG. 4. The side flaps 26 are then folded over, first on fold lines 24 and then on fold lines 28, to form the side walls 58; and then they are overlapped, as at 60, to form the rear wall 62. The overlapped flaps also encompass the internal upper and lower flaps 56, and are secured to each other as well as to the flaps 56 either by adhesive, staples, or any other feasible and desirable means.

With the unit assembled as above-described, in order to place it in use, it is merely necessary to either tear along the upper and side portions of the scored pattern 30 so that a bottom hinged flap 32 remains, or the flap 32 can be removed entirely by tearing all four sides of the scored pattern. In either situation, the topmost bag appearing in the opening can be removed by simply grasping the lip formed by the edge 38 and pulling forward, at which time the bag is torn away from its selvage portion along the score line 42.

During the forward pull on the bag, it is simultaneously removed from the box and opened. The opening force is due to the combined action of the end welds 48 in the base portion of the pad and the front wall portion of the box surrounding the aperture 34. In this respect, the end welds 48 act as an anchor or counterforce to the forward pull on the bag to initiate the opening action at the upper portion of the bag, and then the front wall portion surrounding and framing the opening or aperture 34 acts as an anchor or counterforce against the pulling action for the remainder of the bag. The combination of these two counterforces results in a complete separation and simultaneous full opening of the bag as it is pulled out of the box through the aperture.

In the above-described form of the invention, as shown in FIGS. 1 to 4, the rear wall of the box, to which the pad is stapled or otherwise secured, acts as a stabilizer means to prevent collapse of the pad within the box. However, in some circumstances, it may be desirable to use very flexible material for the box which might not be a satisfactory stabilizing means, or it may be economically feasible in the manufacturing process to first form a stabilized pad in one assembly line and then merely insert it into place in the box in another assembly line.

For either of the above or for other reasons, it is possible to make the unit as shown in FIGS. 5 and 6 wherein the unit, generally designated 100, comprises a box blank 102 and a pad of plastic bags 104, each of which is identical to their corresponding parts in the form of the device shown in FIGS. 1 to 4 and will, therefore, not be further described. However, in this modification, the pad 104 is stapled, as at 106, or otherwise secured at its base portion, to the upper portion of a backer 108 made of cardboard, paper, plastic, or any other desired material.

In assembling the unit 100, the front of the pad 104, while connected to the backer 108, is placed against the inner surface of the front wall of the box blank, without any fastening, and the blank is then folded and secured, as described above, to encompass the pad. The backer, itself, is of such dimensions that its edges substantially abut the corresponding inner surfaces of the box to hold the pad securely therein.

Instead of providing a full support for the pad as is provided by the backer in the form of the device shown in FIGS. 5 and 6, it may be desirable to use only a partial support for the pad 7. This form of the invention is shown in FIG. 7 where the unit, generally designated 200, comprises a box formed of the blank 202 and the pad of plastic bags 204.

The box and pad shown in FIG. 7 are the same as those shown in FIGS. 1 to 6 and will not be further described. However, the pad 204 is provided with the hanger 206 that is inserted between a pair of its bag-forming pockets within the base portion. An extension 208 is integral with the hanger and projects upwardly from the base portion. This extension is stapled, as at 210, or otherwise secured, to the front wall of the box above the score line pattern 212.

Although the hanger 206 will not maintain the pad in uncollapsed position unless it is secured to the front wall of the box, as shown, it does permit pre-assembly of the pad with partial support, the hanger serving to easily align the pad in position during assembly with the box. Furthermore, if desired, the pad, with the hanger, can be removed from the box and hung on a wall or other surface.

The hanger 206 is illustrated in FIG. 7 and has been described as being positioned in the base portion of the pad between a pair of pockets, but is is also possible, if desired, to fasten it to one of the outer surfaces of the base portion.

Figure 10:
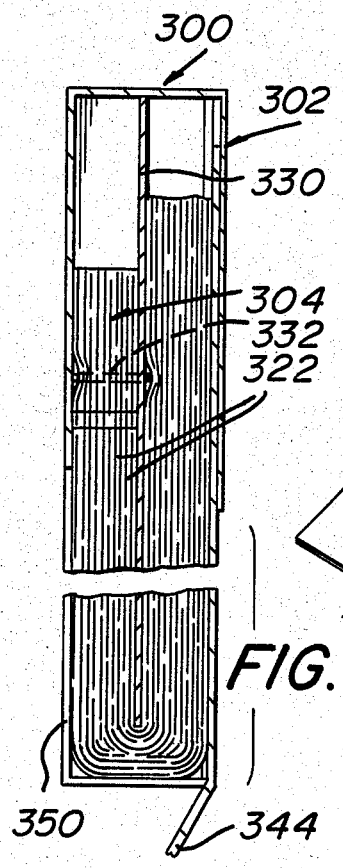
FIG. 10 is a sectional view taken on line 10—10 of FIG. 8.

This invention has, up to now, been described as being utilized with moderate sized plastic bags. However, it is also adapted for large bags while yet maintaining its compactness and ease of handling. A form of the device utilized for large bags is shown in FIGS. 8, 9 and 10.

As shown in FIG. 8, the unit for large bags, generally designated 300, comprises a box 302, which may be of the same general size as the boxes shown in FIGS. 1 to 7, and a pad of plastic bags, generally designated 304, within the box.

Figure 9:
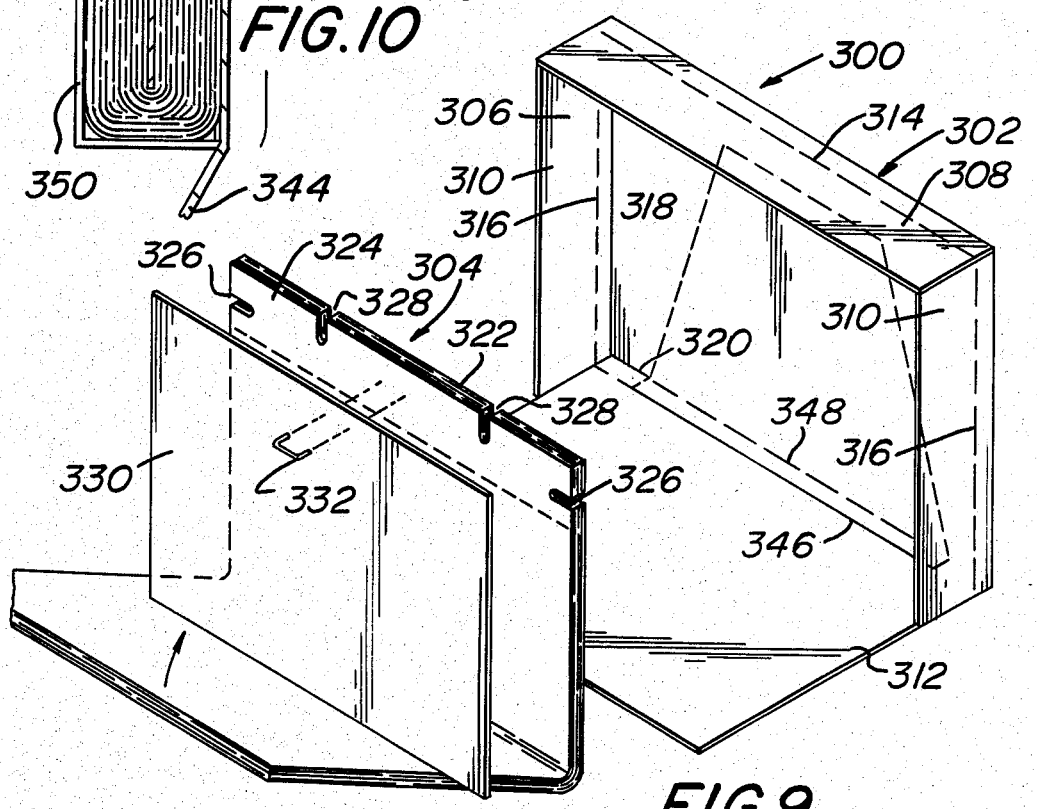
FIG. 9 is an exploded perspective view of the unit of FIG. 8.

The box 302 is made from a blank (as shown in FIG. 9) which is somewhat similar to those described above in that it has a front wall 306 with an upper flap 308, side flaps 310 and bottom flap 312. The upper flap has a longitudinal fold line 314 and the side flaps have longitudinal fold lines 316. The front wall has a scored line pattern 318, generally similar to those in the forms of the device described above; however, the rear portion of this pattern extends partially into the rear wall 312 beyond the fold line 320 which hinges the rear wall to the front wall, as best shown in FIG. 9.

The pad of plastic bags 304 comprises a stack of bag pockets 322 which are similar to those shown in FIGS. 1 to 7 except that they are larger in size. This pad also has a base portion 324 with its end welds 326 and edge welds 328.

The pad 304, before being inserted into the box blank, is folded around a backer 330 made of the same material as the backer 108 in FIGS. 5 and 6, and is stapled, as at 332, or otherwise secured to the backer, adjacent its upper front edge. The bundle, including the folded pad and backer, is then placed into the box blank with the front folded face of the pad facing the score line pattern 318. The upper flap 308 and side flaps 310 of the blank are then folded in the manner described with respect to FIG. 1 to form the top wall 334, side walls 336 and front wall 338. The rear flap 312 is then brought up to form the rear wall 340 and the portion 342 of the flap 308 is overlapped over the rear wall. Staples, adhesive or any other desired fastening means are then used to hold the flaps of the blank in place.

Similarly to the other forms of the invention, the score line pattern forms a flap 344, when torn, which is hinged by a fold line at 346 and which is provided with a bottom score line 348 which can be torn to remove the flap 318 when desired, to leave an aperture 350.

The backer 330 supports the pad 304 to keep it from collapsing and to maintain its folded shape, but the support is sufficiently loose so that when the lip of the topmost pocket appearing in the aperture 350 is pulled through the aperture, the resulting released bag is easily pulled from under the backer and out of the aperture.

The invention claimed is:

1. A plastic bag unit comprising a storage and dispensing container having an aperture in one face thereof, a plastic pad comprising a stack of overlying plastic pockets connected to each other by a common base portion, each of said pockets having a front face and rear face, said front face having an open mouth with a lip, and a selvage portion extending from said mouth and connected thereto by a score line, the selvage portions of all the pockets being connected to each other at least at the opposite end edges thereof by connecting means to form said base portion, said base portion being held in a substantially rigid position within said container with the front faces of the pockets aligned with said aperture and said lips within the area of said aperture in a position to be successively grasped and pulled through said aperture when exposed by removal of the next uppermost overlying pocket, the wall area of the container defining said aperture framing the uppermost pocket, whereby when a forward pull is exerted on the lip of said uppermost pocket, said uppermost pocket is torn along its respective score line from its selvage portion while said connecting means of said base portion exert a counterforce to initiate opening of the resultant bag and said frame simultaneously exerts an additional counterforce to complete said opening of said resultant bag.

2. The bag unit of claim 1 wherein said pad is connected to said container.

3. The bag unit of claim 1 wherein said pad is connected to a backer.

4. The bag unit of claim 3 wherein the backer is connected to the container.

5. The bag unit of claim 1 wherein said pad is connected to a hanger and said hanger is connected to said container.

6. The bag unit of claim 1 wherein said pad is folded around a backer with the portion of the folded pad containing the front faces of the pockets being aligned with said aperture.

7. The bag unit of claim 1 wherein said aperture is defined by a score line pattern which is adapted to be torn partially away to form a covering flap for the aperture or completely away to uncover said aperture.

8. The bag unit of claim 1 wherein said connecting means are welds.

9. The bag unit of claim 1 wherein said container is a relatively flat box.

* * * * *